United States Patent [19]

Lipkovker et al.

[11] Patent Number: 4,741,267

[45] Date of Patent: May 3, 1988

[54] SHUTTLE DRIVE FOR RECIPROCABLY MOUNTED LINE PRINTER CARRIAGES

[75] Inventors: Lev M. Lipkovker, Bellevue, Wash.; Wolfgang G. Wunderlich, deceased, late of Federal Way, Wash., by Erika Wunderlich, heir

[73] Assignee: Mannesmann Tally Corporation, Kent, Wash.

[21] Appl. No.: 844,092

[22] Filed: Mar. 26, 1986

[51] Int. Cl.[4] ..... B41S 3/00

[52] U.S. Cl. ..... 101/93.04; 101/93.05; 400/124

[58] Field of Search ..... 101/93.04, 93.05; 400/121, 125, 125.1, 141, 141.1, 320

[56] References Cited

U.S. PATENT DOCUMENTS

| | | | |
|---|---|---|---|
| 4,127,334 | 11/1978 | Watanabe et al. | 400/320 X |
| 4,278,019 | 7/1981 | Meier | 400/121 X |
| 4,400,104 | 8/1983 | McCray et al. | 400/121 X |
| 4,402,620 | 9/1983 | Kekas et al. | 101/93.04 X |
| 4,481,880 | 11/1984 | Kurosawa et al. | 400/121 X |
| 4,543,884 | 10/1985 | Kikuchi et al. | 101/93.04 |
| 4,573,363 | 3/1986 | Shin | 400/320 X |
| 4,599,007 | 7/1986 | Khorsand | 400/320 X |

FOREIGN PATENT DOCUMENTS

| | | | |
|---|---|---|---|
| 27358 | 3/1981 | Japan | 101/93.04 |
| 12781 | 1/1983 | Japan | 400/121 |
| 176063 | 10/1984 | Japan | 400/320 |

*Primary Examiner*—Charles A. Pearson
*Assistant Examiner*—James R. McDaniel
*Attorney, Agent, or Firm*—Christensen, O'Connor, Johnson & Kindness

[57] ABSTRACT

A weight unbalance shuttle drive for flexure mounted carriages (11) is disclosed. The weight unbalance shuttle drive comprises a pair of motors (49) attached to the flexure mounted carriage (11). Mounted on the shaft of each motor is an unbalancing weight (51). When the motors (49) are energized the unbalancing weights (51) produce carriage drive forces in alternating directions resulting in the carriage (11) being shuttled back and forth. The mass and shape of the unbalancing weights (51) is chosen to produce the desired carriage displacement at the desired system operating frequency. The rotary positions of the unbalance weights (51) is chosen to produce the desired force/displacement amplitude.

23 Claims, 3 Drawing Sheets

Fig. 4.
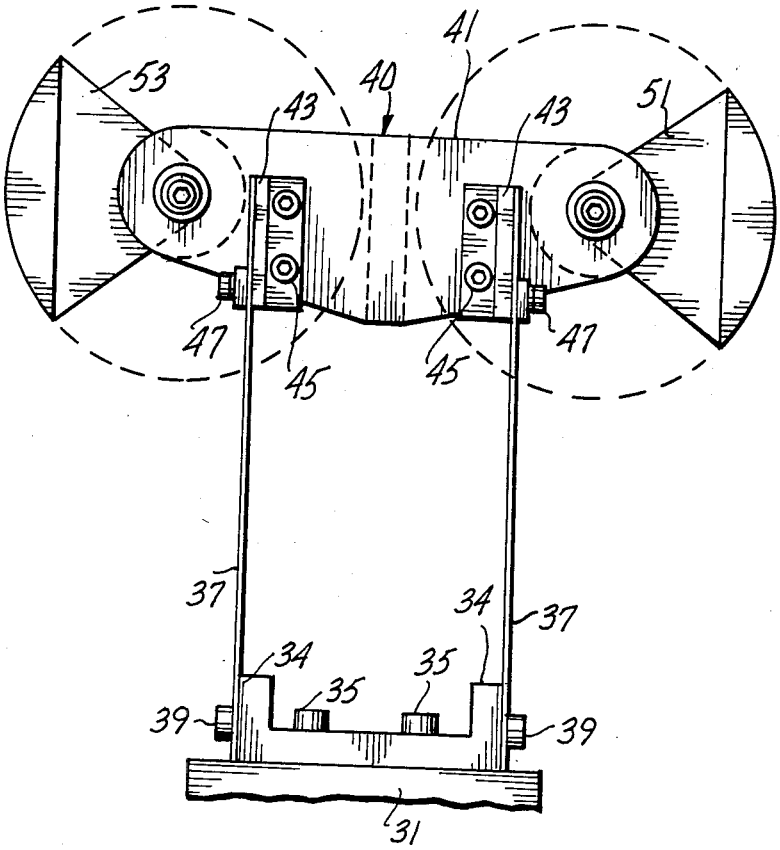
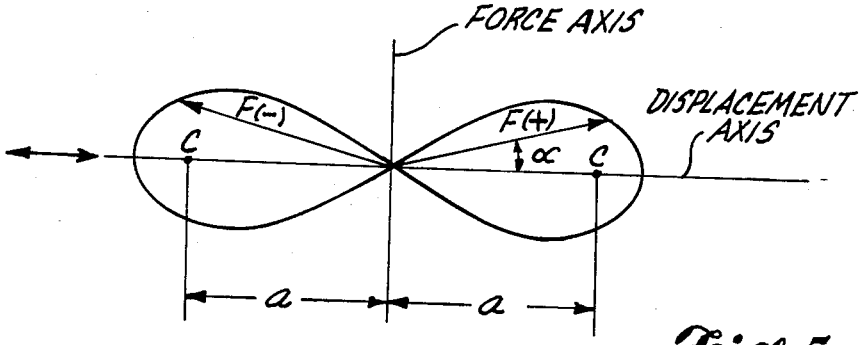
Fig. 5.

SHUTTLE DRIVE FOR RECIPROCABLY MOUNTED LINE PRINTER CARRIAGES

TECHNICAL AREA

This invention relates to shuttling mechanisms and, more particularly, shuttling mechanisms for reciprocably mounted carriages.

BACKGROUND OF THE INVENTION

Various types of dot matrix line printers have been proposed and are in use. In general, dot matrix line printers include a print head comprising a plurality of dot printing mechanisms, each including a dot forming element. The dot forming elements are located along a line that lies orthogonal to the direction of paper movement through the printer. Since paper movement is normally vertical, the dot forming elements usually lie along a horizontal line. Located on the side of the paper remote from the dot forming elements is a platen and located between the dot forming elements and the paper is a ribbon. During printing, the dot forming elements are actuated to create one or more dots along the print line defined by the dot forming elements. The paper is incremented forwardly after each dot row is printed. A series of dot rows creates a row of characters.

In general, dot matrix line printers fall into two categories. In the first category are dot matrix line printers wherein only the dot forming elements are shuttled. In the second category are dot matrix line printers wherein the entire print head, e.g., the actuating mechanism as well as the dot forming elements are shuttled. Regardless of type, the portions of the dot printing mechanisms to be shuttled are mounted on or form a carriage and the carriage is reciprocated back and forth (e.g., shuttled) by a shuttling mechanism. The present invention is useful with both catagories of dot matrix printers. More specifically, while the invention was developed for use in connection with a dot matrix line printer wherein the entire print head is shuttled, the invention can also be utilized with dot matrix line printers wherein only the dot forming elements are shuttled.

In the past, both types of dot matrix line printers, i.e., those wherein only the dot forming elements are shuttled and those wherein the entire print head is shuttled, have been supported by flexures. In most instances, the items to be shuttled are supported by a pair of flexures each formed of an elongate piece of flat spring steel. One end of the flat spring steel piece is attached to the frame of the printer and the other end is attached to the carriage that supports the items to be shuttled. The shuttle drive mechanism of the invention is designed for use with flexure mounted carriages, particularly flexure mounted carriages that support the entire print head of a dot matrix line printer.

In the past, various types of carriage shuttling mechanisms have been proposed to shuttle the flexure supported items of dot matrix line printers of the type described above. One type of carriage shuttling mechanism includes a stepping motor that is connected to the carriage so as to cause step increments of carriage movement. At the end of each step, the appropriate actuating mechanisms are energized to create dots. Bidirectional printing is provided by stepping the carriage first in one direction and then in the opposite direction. A major disadvantage resulting from the use of stepping motors in dot matrix line printers, particularly dot matrix line printers wherein the actuating mechanisms as well as the dot forming elements are shuttled, is that conventionally sized stepping motors have insufficient power to shuttle the print head of such dot matrix line printers. That is, while conventionally sized stepping motors have adequate power to shuttle only the dot forming elements, they are marginal at best in printers wherein the entire print head is shuttled. In addition, stepping motors have a speed limitation that makes them undesirable for use in relatively high speed dot matrix line printers, e.g., 600 and above lines per minute (lpm) dot matrix line printers.

As a result of the inherent limitations of stepping motor shuttle systems, attempts have been made to utilize constant speed AC and DC motors to shuttle the movable items of the print head of dot matrix line printers. One of the major disadvantages of constant speed motor shuttling systems resides in the coupling mechanism used to couple the motors to the carriage that supports the items to be shuttled. In most instances, the coupling mechanism is a cam and cam follower mechanism. Cam/cam follower mechanisms are undesirable in dot matrix line printer shuttle systems because they are subject to mechanical wear. More specifically, dot matrix line printers, particularly in high speed dot matrix line printers, require precision positioning of the dot forming elements at the time they are actuated by their related actuating mechanisms. Mechanical wear is highly undesirable becauses it reduces the precision with which the dot forming elements can be positioned. As positioning precision drops, dot misregistration increases. As a result, printed characters and images are distorted and/or blurred. Distorted and/or blurred images are, of course, unacceptable in environments where high quality printing is required or desired.

Another disadvantage of many prior art carriage shuttling systems that include constant speed motors and cam/cam follower coupling mechanisms is that the displacement vs. time curve that they produce is nonlinear. As a result, relatively sophisticated carriage position sensing and control systems are required if precise dot positioning is to be achieved.

In order to minimize the mechanical wear factor and nonlinear carriage displacement vs. time curve problems produced by prior systems for mechanically coupling a constant speed motor to the print elements of a dot matrix line printer, a proposal has been made to use a coupling system that includes a pair of eliptical pulleys. See U.S. Pat. No. 4,387,642 entitled "Bi-Directional, Constant Velocity, Carriage Shuttling Mechanisms" by Edward D. Bringhurst et al. While the bilobed second order eliptical gear coupling mechanism described in this patent application has certain advantages over prior coupling mechanisms, it also has certain disadvantages. For example, it is undesirably noisy, mechanically complex and more expensive to manufacture than desirable.

In addition to stepping motor systems and constant speed motor systems, in the past, linear motors have been used to shuttle the carriages of printer mechanisms. A linear motor is a motor wherein the axis of movement of the movable element of the motor is rectilinear rather than rotary. One example of a linear motor shuttling system designed to shuttle a flexure mounted carriage that supports the print head of a dot matrix line printer is described in U.S. Pat. No. 4,461,984 entitled "Linear Motor Shuttling System" by C. Gordon Whitaker et al., assigned to the assignee of the present application. While linear motor shuttling systems have proven to be substantially superior to the types of shuttling mechanisms described above, particularly in high speed dot matrix line printers, they also have certain disadvantages. The primary disadvantage of linear motor shuttling systems is their size and cost.

The present invention is directed to providing a shuttle drive for reciprocably mounted carriages, particularly flexure mounted carriages, that overcomes the disadvantages of prior shuttle drive mechanisms. In particular, the present invention is directed to a shuttle drive mechanism for reciprocably mounted carriages that is highly accurate, inexpensive and relatively small in size.

SUMMARY OF THE INVENTION

In accordance with this invention a weight unbalance shuttle drive for a reciprocably mounted carriage is provided. The weight unbalance shuttle drive comprises a motor rotated pair of unbalancing weights attached to the reciprocably mounted carriage. When the motor is energized, the unbalancing weights cause a vibration that produces a carriage drive force in alternating directions, resulting in the carriage being shuttled back and forth.

In accordance with other aspects of this invention, two motors are attached to the carriage. Mounted on the shaft of each motor is one of the unbalancing weights. The mass and shape of the unbalancing weights are chosen to create a vibration that produces the desired carriage displacement at the desired system operating frequency. The rotary positions of the unbalancing weights are chosen to produce the desired force/displacement amplitude.

In accordance with further aspects of this invention, the carriage is supported by a pair of flexures located at either end thereof; and the weight unbalance shuttle drive is attached to one end of the carriage.

In accordance with still other aspects of this invention, the weight unbalance shuttle drive includes a horizontally oriented motor support bracket, that is attached to the flexure supported carriage. The motor support bracket supports the two motors such that the shafts of the motors are vertical.

In accordance with additional aspects of this invention, the motor support bracket is attached to the carriage by a plurality of horizontally oriented connecting rods.

In accordance with yet other aspects of this invention, the unbalancing weights have a pie-shaped configuration. The weights are mounted on the shafts of their respective motors such that the shafts pass through the apex of the pie shape. Preferably, the curved outer region of the pie-shaped weights is thicker and, thus, more massive than the internal apex region.

As will be readily appreciated from the foregoing description, a shuttle drive for a flexure mounted carriage formed in accordance with the invention is relatively uncomplicated and, thus, relatively inexpensive to manufacture and utilize. While inexpensive, the shuttle drive provides precise vibration when the unbalancing weights are driven at the same speed and the size and shape of the unbalancing weights is chosen to produce a desired carriage displacement at desired system operating frequency. The rate of vibration is readily controlled by controlling the speed of rotation of the unbalancing weights. Since shuttle speed is readily controlled, print speed is also readily controlled utilizing a shuttle drive formed in accordance with the invention.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein:

FIG. 4 is a top view of the shuttle drive mechanism illustrated in FIG. 1; and, FIG. 5 is a force vector diagram for a shuttle drive mechanism formed in accordance with the invention.

DESCRIPTION OF THE PREFERRED EMBODIMENT

Figure 1:
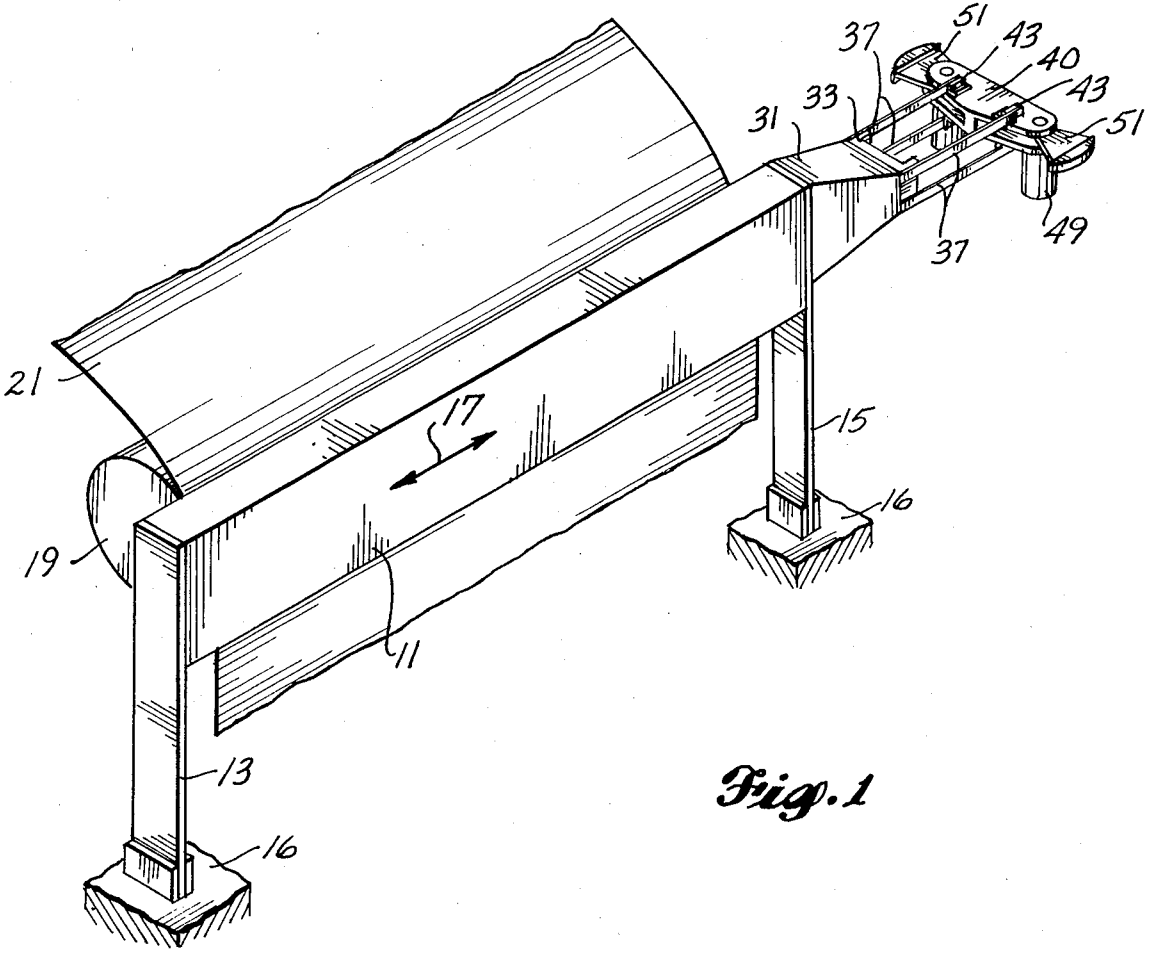
FIG. 1 is a pictorial diagram illustrating the mounting and positioning of a flexure mounted carriage and the mechanical components of a shuttle drive mechanism formed in accordance with the invention.
Figure 2:
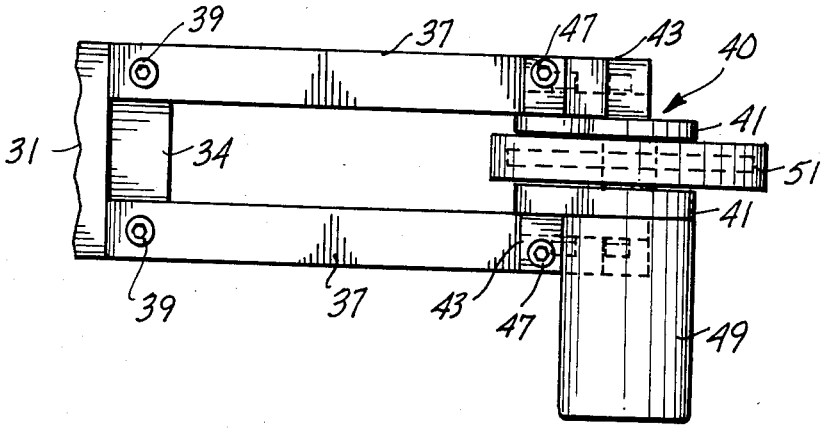
FIG. 2 is a side elevational view of the shuttle drive mechanism illustrated in FIG. 1.

FIG. 1 is a pictorial diagram illustrating the print head 11 of a dot matrix line printer supported by a pair of flexures 13 and 15. Thus, the print head forms a flexure supported carriage. Since the print head 11 does not form a portion of this invention, it is illustrated in schematic form. By way of example, the print head 11 may take the form of the print head described in U.S. Pat. No. 4,351,235 entitled "Dot Printing Mechanism for Dot Matrix Line Printers" filed Sept. 11, 1980 by Edward D. Bringhurst and assigned to the assignee of the present application. Preferably, the print head flexures 13 and 15 are formed of elongate pieces of flat spring steel having one end attached to the frame 16 of the printer. The flexures 13 and 15 are aligned with one another and lie in parallel planes separated by the length of the print head 11.

The print head 11 is mounted between the movable ends of the flexures 13 and 15 so as to be rectilinearly movable in the direction of the arrow 17. The arrow 17 lies paralle to the longitudinal axis of the print head and orthogonal to the parallel planes in which the flexures 13 and 15 lie.

As will be readily appreciated by those familiar with dot matrix line printers, particularly after reviewing U.S. Pat. No. 4,351,235 referenced above, the length of the print head is substantially equal to the width of the maximum size of the paper 21 acceptable by the dot matrix printer of which it forms a part. The print head may include sixty six (66) separate dot printing mechanisms each of which is designed to scan or cover two character positions, for example. The total or maximum character line width of such a printer is one hundred and thirty two (132) characters. Since the number of character positions to be scanned (two) is small compared to the number of printing mechanisms (66), obviously, the shuttle distance is small when compared to the length of the print head.

For orientation purposes a platen 19 is illustrated in FIG. 1 as lying parallel to the print head 11 on the other side of the paper 21 from the print head. While not shown in FIG. 1, obviously, a suitable ink source (e.g., a ribbon) must be located between the print head 11 and the paper 21. The print head flexures 13 and 15 are located adjacent to the edge of the paper 21.

Mounted on one end of the print head 11 is a bracket 31. More specifically, the bracket 31 is mounted on the side of one of the flexures 15 remote from the side attached to the print head 11, such that the bracket 31 is aligned with the carriage 17. Mounted on the outer end of the bracket 31 is a plate 33. The plate may be attached to the bracket 31 by bolts 35, for example, as shown in FIG. 4, or be unitarily formed with the bracket. When viewed from above, the plate 33 has a U-shaped cross-sectional configuration. Thus, the arms 34 of the plate 33, which extend outwardly from the bracket 31 are vertically oriented. Attached to the arms 34 of the U-shaped plate 33 is one end of each of four connecting rods 37. The connecting rods are flat, preferably formed of steel. The connecting rods may be attached to the arms 34 by bolts 39, for example. The connecting rods all lie in horizontal planes and are spaced from another. More specifically, one pair of connecting rods 37 is connected to one of the arms 34 of the U-shaped plate 33 and the other pair is connected to the other arm 34. Further, the connecting rods 37 are connected to their respective arms near the top and the bottom edges thereof.

Figure 3:
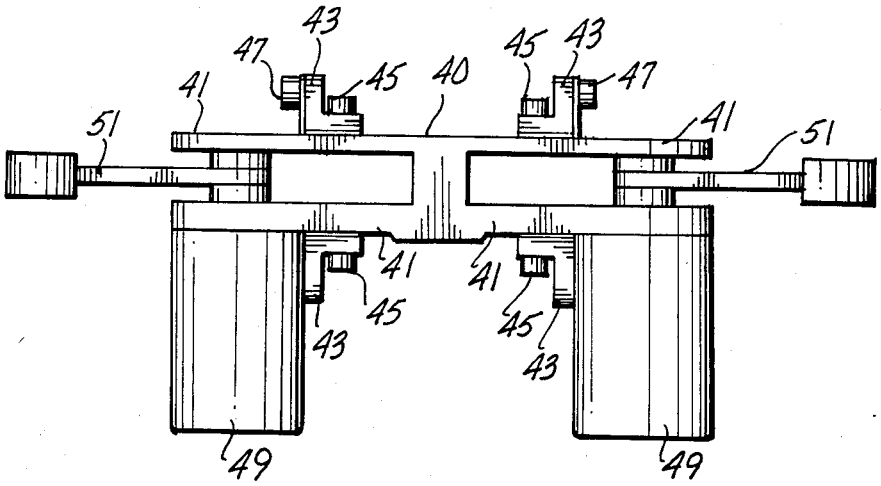
FIG. 3 is an end elevational view of the shuttle drive mechanism illustrated in FIG. 1.

Mounted on the outer ends of the connecting rods 37 is a motor support bracket 40. As best illustrated in FIG. 3, the side of the the motor support bracket 40 facing the print head 11 has an I-shaped configuration, the legs 41 of which are relatively long when compared with the web 42. The connecting rods 37 are attached to the motor support bracket 40 by four angle brackets 43. Two of the angle brackets 43 are affixed to the top of the motor support bracket 40 and two are affixed to the bottom. The angle brackets may be affixed to the motor support bracket by bolts 45, for example. The angle brackets 43 may be affixed to their associated connecting rod 37 by bolts 47, for example.

Attached to the bottom of the motor support bracket 40, near the outer end of the lower legs 41, are a pair of electric motors 49. More specifically, the housing of one of the electric motors 49 is attached to the outer end of each of the bottom of the lower legs 41 of the I-shaped motor support bracket 40. The shafts of the motors 49 are journalled in the upper and lower legs of the motor support bracket lying immediately above the housings of the motors 49. Affixed to the shafts of the motors between the upper and lower legs 41 of the motor support bracket 40 are unbalancing weights 51.

As best illustrated in FIG. 4, when viewed from above, the unbalancing weights 51 have a pie-shaped configuration. The apex of the pie-shape is affixed to the shaft of the respective motor 49 and the center plane of the pie-shaped pieces lies in a plane of rotation that passes between the related legs 41 of the motor support bracket 40. The thickness and diameter of the pie-shape is such that the unbalancing weights 51 can freely rotate through the slots defined by the upper and lower legs 41 of the motor support bracket 40. As best seen in FIG. 3, when viewed from the side, the unbalancing weights 51 include a thin inner section and a thicker outer section. The thicker outer section results in displacing the center of mass of the unbalancing weights further from the shaft of the related motor than would be the case of a uniform thickness unbalance weight. The result of this center of mass change is the creation of a larger centrifugal force.

In operation, when the motors 49 are energized, the unbalancing weights 51 are rotated in opposite directions. Rotation of the unbalancing weights in opposite directions unidirectionally vibrates the motor support bracket 40. The motor support bracket vibration is transferred to the printer carriage 11 by the connecting rods 37 and the bracket 31. As a result, the carriage 11 is vibrated by the vibration created by the unbalancing weights. The unidirectional force plus the fact that the direction of carriage movement is controlled by the flexures (which only allow movement in the direction of the arrow 17), results in the transferred vibration causing movement only in the allowed direction. As a result, the carriage is shuttled back and forth, in front of the paper 21.

The motors 49 may be DC motors or AC motors. In either case, controlling the speed of rotation of the unbalancing weights controls the frequency of vibration and, thus, the shuttle speed. In accordance with the invention the mass and shape of the unbalancing weights is chosen to produce the desired carriage displacement at the desired system operating frequency. The rotational positions of the unbalancing weights is chosen to produce the desired force/displacement amplitude.

FIG. 5 is a Lemniskata/Bernully force vector diagram depicting the phase and amplitude of the exciting force. In FIG. 5, F represents the exciting force vector; $\alpha$ represents the phase angle of F; and, a is the distance from the zero force vector point to the polar points of the unbalancing weights, which points are represented by the letter C. The double ended arrow represents the direction of movement. The force vector is defined by the following equation:

$$F^2 = 2a^2 \cos\angle\alpha$$

As will be readily appreciated from the foregoing description, the invention provides an uncomplicated and inexpensive shuttle drive for shuttling a flexure supported carriage. The invention is ideally suited for shuttling the print head of a dot matrix line printer, particularly a dot matrix line printer having variable printing speed requirements. In this regard, most dot matrix line printers have various modes of operation, such as a letter mode of operation and a draft mode of operation. In the letter mode of operation, the dot density is considerably higher than in the draft mode of operation. While dot density is higher, carriage movement is slower since more dots must be printed as the carriage is shuttled back and forth. The invention is ideally suited for use in such a printer since carriage movement can be readily controlled by controlling the speed of the motors that rotate the unbalancing weights. The invention has the further advantage of being easily "tuned" to a particular printer by controlling the mass, shape and rotary position of the unbalancing weights.

While a preferred embodiment of the invention has been illustrated and described, it will be appreciated that various changes can be made therein without departing from the spirit and scope of the invention. For example, rather than mounting the shuttle drive on the end of a carriage, it could be mounted on brackets attached to the midregion of the carriage. Further, while the carriage is illustrated as being supported by vertical flexures, the longitudinal axis of the flexures can lie in planes other than vertical planes—horizontal planes, or inclined planes for examples. In addition while two unbalanced shaft motors are preferred, a single unbalance shaft motor can be utilized. Hence, the invention can be practiced otherwise than as specifically described herein.

The embodiments of the invention in which an exclusive property or privilege is claimed are defined as follows:

1. In a line printer wherein a series of printing mechanisms are positioned side by side on an elongate carriage supported for reciprocating movement along a linear, horizontally oriented axis lying parallel to a horizontally oriented print line defined by said printing mechanisms, the improvement comprising a twin counterweight shuttle drive, for said carriage, said twin counterweight shuttle drive including:

a support bracket secured to said carriage suitable for supporting a pair of rotatably mounted unbalancing weights;

a pair of equally sized and configured unbalancing weights rotatably mounted on and entirely supported by said support bracket, said unbalancing weights being positioned so that the carriage driving force produced by each weight is in phase with the carriage driving force produced by the other weight such that the rotation of said unbalancing weights in opposite directions at the same speed creates a reciprocating unidirectional drive force that reciprocably shuttles said carriage along said linear, horizontally oriented axis said drive force resulting from rotation of said unbalanced weights being the sole drive force causing said reciprocating motion of said carriage; and, rotation means coupled to said pair of equally sized and configured unbalancing weights for rotating said pair of equally sized and configured unbalancing weights in opposite directions at the same speed.

2. The improvement claimed in claim 1 wherein said support bracket and, thus, said pair of equally sized and configured unbalancing weights, is secured to one end of said elongate carriage.

3. The improvement claimed in claim 1 wherein said reciprocably mounted carriage is supported by flexures.

4. The improvement claimed in claim 3 wherein said support bracket and, thus, said pair of equally sized and configured unbalancing weights is secured to one end of said elongate carriage.

5. The improvement claimed in claim 3 wherein said flexures that support said carriage comprise a pair of flexures, one positioned at either end of said carriage.

6. The improvement claimed in claim 5 wherein said support bracket and, thus, said pair of equally sized and configured unbalancing weights, is secured to one end of said elongate carriage.

7. The improvement claimed in claim 1 wherein said rotation means includes electric motor means mounted on said support bracket and connected to said pair of equally sized and configured unbalancing weights for rotating said pair of equally sized and configured unbalancing weights.

8. The improvement claimed in claim 7 wherein said support bracket and, thus, said pair of equally sized and configured unbalancing weights, is secured to one end of said elongate carriage.

9. The improvement claimed in claim 8 wherein said reciprocably mounted carriage is supported by flexures.

10. The improvement claimed in claim 9 wherein said flexures that support said carriage comprise a pair of flexures, one positioned at either end of said carriage.

11. The improvement claimed in claim 7 wherein said electric motor means comprises first and second electric motors mounted on said support bracket and wherein said pair of equally sized and configured unbalancing weights are coupled to said electric motor means by mounting one of said unbalancing weights on the shaft of each of said electric motors.

12. The improvement claimed in claim 1 wherein the mass and shape of said pair of equally sized and configured unbalancing weights is chosen to produce a predetermined amount of carriage displacement at the chosen system operating frequency.

13. The improvement claimed in claim 12 wherein said support bracket and, thus, said pair of equally sized and configured unbalancing weights, is secured to one end of said elongate carriage.

14. The improvement claimed in claim 13 wherein said reciprocably mounted carriage is supported by flexures.

15. The improvement claimed in claim 14 wherein said flexures that support said carriage comprise a pair of flexures, one positioned at either end of said carriage.

16. The improvement claimed in claim 15 wherein said rotation means includes electric motor means mounted on said support bracket and connected to said pair of equally sized and configured unbalancing weights for rotating said pair of equally sized and configured unbalancing weights.

17. The improvement claimed in claim 13 wherein said rotation means includes electric motor means mounted on said support bracket and connected to said pair of equally sized and configured unbalancing weights for rotating said pair of equally sized and configured unbalancing weights.

18. The improvement claimed in claim 1 wherein the relative rotary positions of said pair of equally sized and configured unbalancing weights is chosen to produce a predetermined carriage force/displacement amplitude.

19. The improvement claimed in claim 18 wherein said support bracket and, thus, said pair of equally sized and configured unbalancing weights, is secured to one end of said elongate carriage.

20. The improvement claimed in claim 19 wherein said reciprocably mounted carriage is supported by flexures.

21. The improvement claimed in claim 20 wherein said flexures that support said carriage comprise a pair of flexures, one positioned at either end of said carriage.

22. The improvement claimed in claim 21 wherein said rotation means includes electric motor means mounted on said support bracket and connected to said pair of equally sized and configured unbalancing weights for rotating said pair of equally sized and configured unbalancing weights.

23. The improvement claimed in claim 19 wherein said rotation means includes electric motor means mounted on said support bracket and connected to said pair of equally sized and configured unbalancing weights for rotating said pair of equally sized and configured unbalancing weights.

* * * * *